US011739611B2

(12) United States Patent
Acosta Villarreal et al.

(10) Patent No.: US 11,739,611 B2
(45) Date of Patent: Aug. 29, 2023

(54) SINGLE SLEEVE, MULTI-STAGE CEMENTER

(71) Applicant: Halliburton Energy Services, Inc., Houston, TX (US)

(72) Inventors: Frank Vinicio Acosta Villarreal, Houston, TX (US); Ahmad Rizal Maharam, Senai (MY); Saul Emmanuel Vazquez Niebla, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 96 days.

(21) Appl. No.: 17/124,638

(22) Filed: Dec. 17, 2020

(65) Prior Publication Data

US 2022/0195835 A1 Jun. 23, 2022

(51) Int. Cl.
*E21B 33/14* (2006.01)
*E21B 34/06* (2006.01)

(52) U.S. Cl.
CPC ..... *E21B 33/146* (2013.01); *E21B 34/063* (2013.01); *E21B 2200/06* (2020.05)

(58) Field of Classification Search
CPC .. E21B 33/146; E21B 34/063; E21B 2200/06; E21B 33/00
See application file for complete search history.

(56) References Cited

U.S. PATENT DOCUMENTS 3,097,699 A 7/1963 Orr
3,451,476 A 6/1969 Pitts
4,286,662 A 9/1981 Page, Jr.
4,674,569 A 6/1987 Revils et al.
5,109,925 A * 5/1992 Stepp ..... E21B 33/146 166/324
5,279,370 A * 1/1994 Brandell ..... E21B 33/128 166/184
7,857,052 B2 * 12/2010 Giroux ..... E21B 33/146 166/291
7,866,392 B2 * 1/2011 Rogers ..... E21B 33/14 166/291
8,215,404 B2 7/2012 Makowiecki et al.

FOREIGN PATENT DOCUMENTS

EP 2826951 A2 1/2015
WO 2014107805 A1 7/2014

* cited by examiner

*Primary Examiner* — Catherine Loikith

(74) *Attorney, Agent, or Firm* — Sheri Higgins Law, PLLC; Sheri Higgins

(57) ABSTRACT

A single sleeve, multi-stage cementing tool for cementing in a wellbore can include a tool body, an outer mandrel, a flow port for providing fluid communication transversely from the inside of a tubing string into an annulus, and a port plug. The port plug is located within the flow port during first stage cementing such that the cement flows into the annulus from a bottom of the tubing string. The bottom of the tubing string can be closed after the first stage, and the port plug can be released from the flow port by increasing pressure within the tubing string. Second stage cementing can then be performed such that the cement flows into the annulus directly through the opened flow port. After all cement stages have been completed, a closing sleeve can be shifted to close the flow port.

20 Claims, 4 Drawing Sheets

SINGLE SLEEVE, MULTI-STAGE CEMENTER

TECHNICAL FIELD

The field relates to a multi-stage cementer for oil or gas operations. A single sleeve can be used to commence second stage cementing operations.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
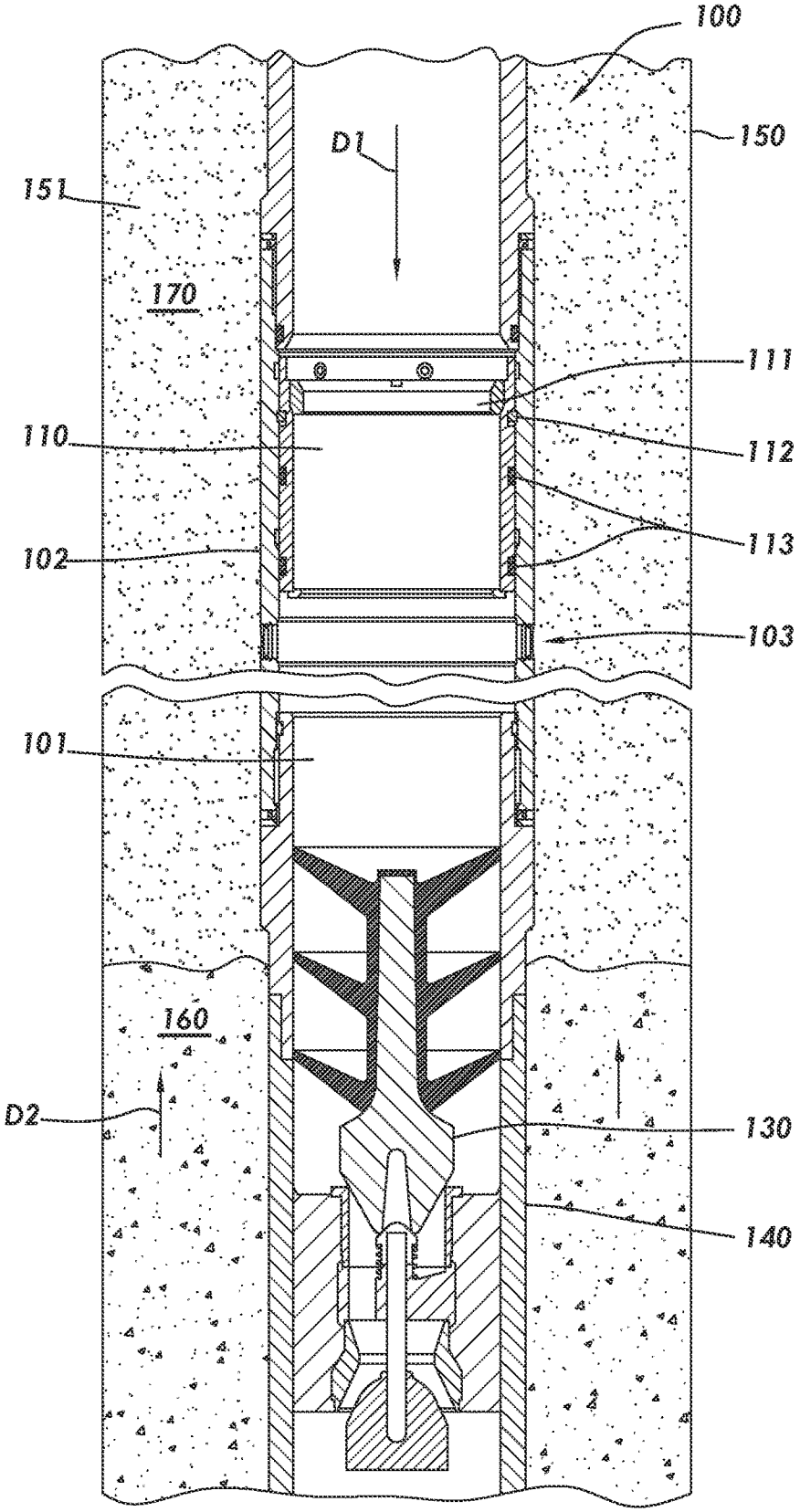
FIG. 1 illustrates a cementing tool during run in and first stage cementing according to certain embodiments.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that can flow and conform to the outline of its container when the substance is tested at a temperature of 71° F. (22° C.) and at a pressure of one atmosphere "atm" (0.1 megapascals "MPa"). A fluid can be a liquid or gas. A homogenous fluid has only one phase; whereas a heterogeneous fluid has more than one distinct phase. A colloid is an example of a heterogeneous fluid. A heterogeneous fluid can be: a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase. As used herein, the term "base fluid" means the solvent of a solution or the continuous phase of a heterogeneous fluid and is the liquid that is in the greatest percentage by volume of a treatment fluid.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A wellbore is formed using a drill bit. A drill string can be used to aid the drill bit in drilling into the subterranean formation to form the wellbore. The drill string can include a drilling pipe. During drilling operations, a drilling fluid, sometimes referred to as a drilling mud, may be circulated downwardly through the drilling pipe, and back up the annulus between the wellbore and the outside of the drilling pipe. The drilling fluid performs various functions, such as cooling the drill bit, maintaining the desired pressure in the well, and carrying drill cuttings upwardly through the annulus between the wellbore and the drilling pipe.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wall of a wellbore and the outside of a tubing string in an open-hole wellbore; the space between the wall of the wellbore and the outside of a casing in a cased-hole wellbore; and the space between the inside of a casing and the outside of a tubing string in a cased-hole wellbore.

During well completion, it is common to introduce a cement composition into an annulus in a wellbore. For example, in a cased-hole wellbore, a cement composition can be placed into and allowed to set in the annulus between the wellbore wall and the outside of the casing in order to stabilize and secure the casing in the wellbore. By cementing the casing in the wellbore, fluids are prevented from flowing into the annulus. Consequently, oil or gas can be produced in a controlled manner by directing the flow of oil or gas through the casing and into the wellhead. Cement compositions can also be used in primary or secondary cementing operations, well-plugging, or squeeze cementing.

As used herein, a "cement composition" is a mixture of at least cement and water. A cement composition can include additives. As used herein, the term "cement" means an initially dry substance that develops compressive strength or sets in the presence of water. Some examples of cements include, but are not limited to, Portland cements, gypsum cements, high alumina content cements, slag cements, high magnesia content cements, sorel cements, and combinations thereof. A cement composition is a heterogeneous fluid including water as the continuous phase of the slurry and the cement (and any other insoluble particles) as the dispersed phase. The continuous phase of a cement composition can include dissolved substances.

A spacer fluid can be introduced into the wellbore after the drilling fluid and before the cement composition. The spacer fluid can be circulated down through a drill string or tubing string and up through the annulus. The spacer fluid functions to remove the drilling fluid from the wellbore by pushing the drilling fluid through the casing and up into the annulus towards a wellhead.

A cement composition can then be introduced after the spacer fluid into the casing. There can be more than one stage of a cementing operation. Each stage of the cementing operation can include introducing a different cement composition that has different properties, such as density. A lead cement composition can be introduced in the first stage, while a tail cement slurry can be introduced in the second stage. Other cement compositions can be introduced in third, fourth, and so on stages.

A cement composition should remain pumpable during introduction into a wellbore. A cement composition will ultimately set after placement into the wellbore. As used herein, the term "set," and all grammatical variations thereof, are intended to mean the process of becoming hard or solid by curing. As used herein, the "setting time" is the difference in time between when the cement and any other ingredients are added to the water and when the composition has set at a specified temperature. It can take up to 48 hours or longer for a cement composition to set. Some cement compositions can continue to develop compressive strength over the course of several days. The compressive strength of a cement composition can reach over 10,000 pounds force per square inch "psi" (69 MPa).

During first stage cementing operations, a first cement composition (e.g., a lead slurry) can be pumped from the wellhead, through the casing and a downhole tool, which can include a float shoe or collar, out the bottom of the casing, and into an annulus towards the wellhead. At the conclusion of the first stage, a shut-off plug can be placed into the casing, wherein the plug engages with a restriction near the bottom of the casing, such as a seat, and closes a fluid flow path through the casing.

After the casing has been shut off, an opening plug can be dropped into the casing. This plug can engage with a seat that causes pressure to build up within the casing above this plug. When the pressure increases sufficiently, an opening sleeve of a cementing tool can shift downwardly to open flow ports that allow a fluid to flow from the inside of the casing into the annulus. Because the casing has been shut off from the shut-off plug, the opening plug cannot be pumped to the desired location in a fluid. Rather, the opening plug must be dropped into the casing where gravity carries the opening plug to the seat through the fluid. Not only does it take time for the opening plug to engage with the seat (oftentimes taking 2 or more hours), but it also prevents multi-stage cementing operations to be performed in horizontal wellbore portions.

After the flow ports have been opened via shifting of the opening sleeve, subsequent stages of the cementing operation can commence. Second-stage, third-stage etc. cement compositions can be pumped from the wellhead and through the inside of the casing. The cement composition(s) flow through the opened flow ports and into the annulus.

When all stages of cementing have concluded, a closing plug can be pumped into the casing to engage with a seat on a closing sleeve of the cementing tool, thereby causing a closing sleeve to shift downwardly and close the flow ports. In order to restore fluid communication through the casing, the closing plug and seat, the opening plug and seat, and the shut-off plug and seat can be drilled or milled out.

There are several disadvantages to the current designs of multi-stage cementing tools. Firstly, having both an opening sleeve and a closing sleeve requires two seats, two plugs, and necessitates a longer tool body to accommodate both sleeves and a longer travel distance for shifting. A longer tool body inherently is more expensive. Secondly, costs are increased in both materials and time for seating an opening plug to open flow ports. Lastly, multi-stage cementing in horizontal wellbore portions may not be possible because there is no way to land the opening plug. Thus, there is a need for improved multi-stage cementing tools that reduce time and costs and can be used in a variety of wellbores.

A cementing tool can be used to perform a multi-stage cementing operation. The cementing tool can include a single sliding sleeve and a port plug that is releasably connected within a flow port. The port plug can be connected within the flow port during a first stage of cementing. Pressure can be increased within a casing string to expel the port plug from the flow port; thereby opening a fluid flow path into an annulus via the opened flow port for a second stage of cementing. The sliding sleeve can then be caused to shift to close the flow port after all stages have been completed. The use of a single closing sleeve greatly reduces the cost of materials and time currently required to shift an opening sleeve. Another advantage to the cementing tool is that the total volume of material required for various components, such as the single sliding sleeve, can be reduced up to 80%.

A multi-stage cementing tool for cementing in a wellbore can include: a body configured to fit within a tubing string; an outer mandrel located around an outside of at least a portion of the body; a flow port, wherein the flow port is defined by an opening that traverses through a portion of the outer mandrel for fluid communication with an inside of the tubing string and an annulus of the wellbore; a port plug, wherein the port plug is releasably connected to the outer mandrel by a frangible device, and wherein the port plug is located within the flow port when the port plug is releasably connected to the outer mandrel; and a closing sleeve located within the body and positioned above the flow port when the closing sleeve is in a pre-shifted position.

Methods of performing a multi-stage cementing operation in a wellbore can include: introducing a tubing string and the cementing tool installed within the tubing string into the wellbore; introducing a first cement composition into the wellbore through the tubing string; closing a fluid flow path through a bottom end of the tubing string; releasing the port plug from connection with the outer mandrel, wherein releasing the port plug opens the flow port to fluid communication from the inside of the tubing string and the annulus of the wellbore; and introducing a second cement composition into the annulus via the flow port.

It is to be understood that the discussion of any of the embodiments regarding the cementing tool is intended to apply to all of the method and apparatus embodiments without the need to repeat the various embodiments throughout. Any reference to the unit "gallons" means U.S. gallons.

Turning to the figures, FIG. 1 illustrates the cementing tool 100 during introduction into a wellbore—commonly known in the industry as being run in. The cementing tool 100 includes a body 101. The body 101 can be configured to fit within a tubing string 140, for example, via casing box X pin connectors. The tubing string 140 and the cementing tool 100 can be introduced into a wellbore that is defined by a wellbore wall. The tubing string 140 can be a casing string, wherein an annulus 151 can be defined as the space located between a wellbore wall 150 and the outside of the casing string 140 and body 101 in an open-hole wellbore. For a cased wellbore, an annulus 151 can defined as the space located between the inside of a casing string 150 and the outside of the tubing string 140 and body 101.

The cementing tool 100 can include an outer mandrel 102 located around at least a portion of the body 101. The cementing tool 100 includes at least one flow port 103. As can be seen in more detail in FIG. 2, the flow port 103 is defined by an opening that traverses through a portion of the outer mandrel 102. The opening of the flow port 103 can be a variety of dimensions and shapes. By way of an example, the diameter of the opening can range from 1 inch "in." to 10 in. The diameter of the opening can be selected, in part, based on the desired fluid volume and/or flow rate of a fluid through the flow port 103. The opening can be any shape, for example, circular, square, rectangular, or other geometric shapes. There can also be more than one flow port 103 located in a variety of spacing distances from each other. Additional flow ports may be beneficial as a redundancy measure to ensure fluid communication can be achieved.

Figure 3:
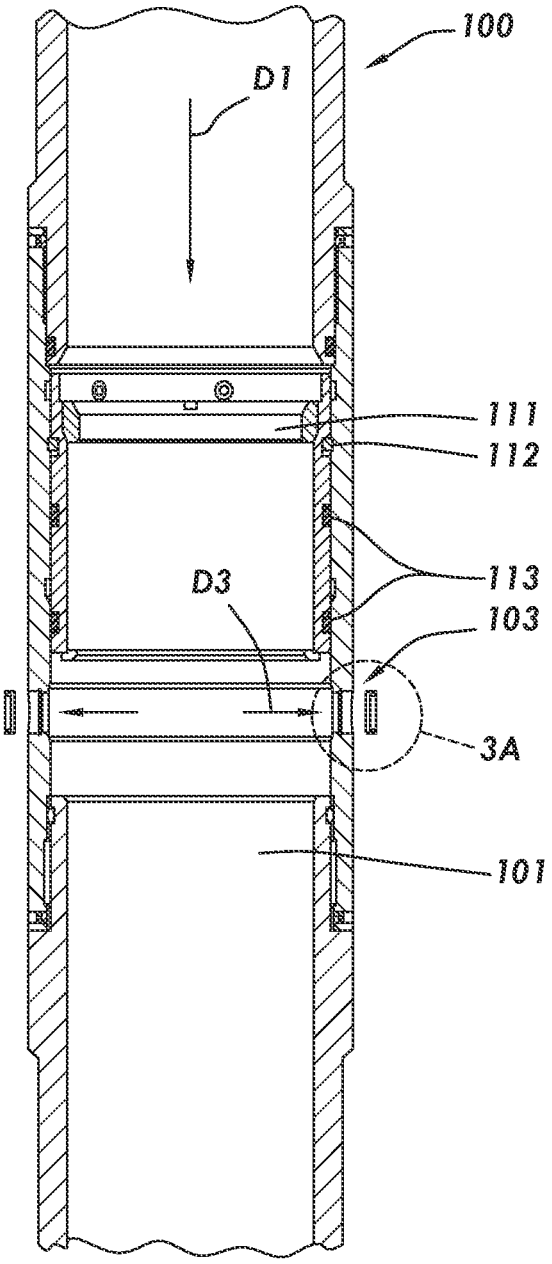
FIG. 3 illustrates the cementing tool during second stage cementing operations according to certain embodiments.
Figure 3A:
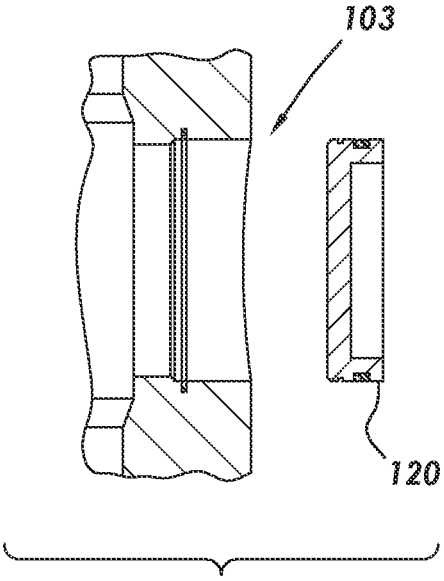
FIG. 3A is an enlarged view of a flow port and port plug of FIG. 3.

The flow port 103 is for fluid communication with an inside of the tubing string 140 and the annulus 151 of the wellbore as described above. The flow port 103 can be oriented on the outer mandrel 102 such that a fluid (e.g., a cement composition) can flow through the flow port 103 in a direction that is transverse to a longitudinal axis of the tubing string 140. By way of example, and as shown in FIG. 3, a fluid can flow through the tubing string 140 from a wellhead in the direction D1 and through the flow port 103 in the direction D3.

The cementing tool 100 includes a port plug 120 in various stages of the cementing operation. FIG. 1 shows the cementing tool 100 in the run-in stage and during a first stage of a cementing operation. During the first stage of a cementing operation, a first cement composition 160 (e.g., a lead cement slurry) can be introduced into the wellbore, for example by being pumped from a wellhead, flow through an inside of the tubing string 140 and the cementing tool 100 in direction D1, exit a bottom end of the tubing string, and flow upwardly through the annulus 151 towards the wellhead in direction D2. As used herein, the relative term "bottom" is provided for reference and means at a location farther away from a wellhead. The term "bottom" is not meant to limit the context to a vertical arrangement, but can be interpreted for horizontal wellbore portions wherein the "bottom" may be to the right or left of the orientation reference. The first cement composition is prevented from flowing through the flow port 103 by the port plug 120. The first cement composition 160 can displace a fluid 170 (e.g., a drilling mud or spacer fluid) in a bottom portion of the annulus 151.

Figure 2:
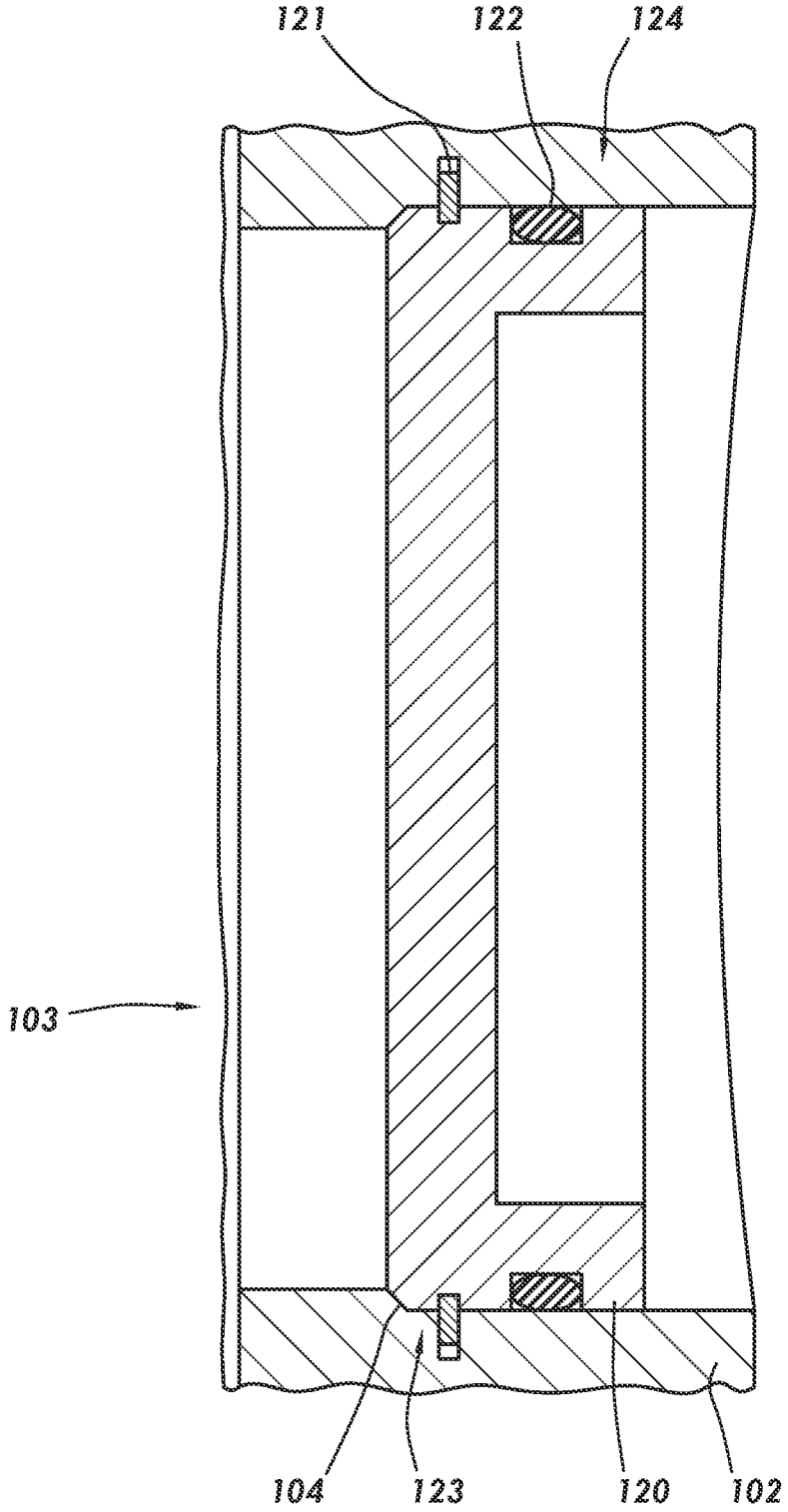
FIG. 2 is an enlarged, cross-sectional view of a flow port and port plug of FIG. 1.

The port plug 120 is shown in more detail in FIG. 2. The port plug 120 can have outer dimensions and a shape selected such that the port plug 120 fits within the flow port 103. According to any of the embodiments, fluid flow is substantially restricted or prevented from flowing past the port plug 120 while the port plug 120 is releasably connected to the outer mandrel 102. By way of example, the outer dimensions of the port plug 120 can be selected such that the clearance restricts or prevents the fluid flow. The port plug 120 can also include a sealing element 122, such as an O-ring, located around an outer perimeter of the port plug and an inner perimeter of the flow port to substantially restrict or prevent fluid flow.

The port plug 120 can be made from a variety of materials. Examples of suitable materials include, but are not limited to, metals, metal alloys, composite materials, dissolvable materials, or hardened plastics. The port plug 120 can be made from aluminum or steel as an example. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin. According to any of the embodiments, the force rating of the port plug 120 is greater than or equal to the force rating of the tubing string 140. Comparable force ratings can be used for safety guidelines and help ensure that undesirable deformation of the port plug 120 does not occur.

With continued reference to FIG. 2, a first end 123 of the port plug 120 can include tapered side walls, while a second end 124 can be straight. A shoulder 104 can be formed on the flow port 103. Accordingly, the tapered side walls of the port plug 120 can shoulder up against the shoulder 104 of the flow port 103 such that the port plug 120 is prevented from releasing through the flow port 103 and into the inside of the tubing string 140. The shoulder 104 can be used in addition to the frangible device 121 to prevent release of the port plug 120 into the tubing string 140.

The port plug 120 is releasably connected to the outer mandrel 102 by a frangible device 121. The frangible device 121 can be any device that is capable of withstanding a predetermined amount of force and capable of releasing at a force above the predetermined amount of force. The frangible device 121 can be, for example, a shear pin, a shear screw, a shear ring, a load ring, a lock ring, a rupture disk, a pin, or a lug. There can also be more than one frangible device 121 that connects the port plug 120 to the outer mandrel 102. The frangible device 121 or multiple frangible devices can be selected based on the force rating of the device, the total number of devices used, and the predetermined amount of force needed to release the device. For example, if the total force required to break or shear the frangible device is 3,000 pounds force "$lb_f$" and each frangible device has a rating of 1,000 $lb_f$, then a total of three frangible devices may be used. The force rating of the frangible device 121 can vary and be selected based on the tubing string 140 weight and material grade among other factors. According to any of the embodiments, the force rating of the frangible device 121 is less than 80% of the force rating of the tubing string 140. By contrast, the force rating of the frangible device 121 can be a minimum force rating such that premature release of the port plug 120 does not occur.

The cementing tool 100 can include a closing sleeve 110 located within the body 101. FIG. 1 shows the closing sleeve 110 when the cementing tool 100 is in the run-in position and during the first stage of a cementing operation. As can be seen, the closing sleeve 110 is positioned above (i.e., closer to the wellhead) the flow port 103 in a pre-shifted position. The closing sleeve 110 can be held in this pre-shifted position via a frangible device 112. The frangible device 112 can be the same as or different from the frangible device 121 of the port plug 120. The frangible device 112 can have the same force rating or a different force rating from the frangible device 121 of the port plug 120. The discussion above regarding the type, number, and individual force ratings of the frangible device 121 of the port plug 120 apply to the discussion of the frangible device 112 of the closing sleeve 110. The closing sleeve 110 can also include a lock ring 111 and one or more sealing elements 113, such as, for example, O-rings.

The methods include introducing a first cement composition 160 into the wellbore through the tubing string 140. As discussed above, the first cement composition 160 can flow up into the annulus 151 and displace a predetermined volume of fluid 170. The methods can include closing a fluid flow path through a bottom end of the tubing string 140. Referring to FIG. 1, the fluid flow path can be closed by dropping or pumping a shut-off plug 130 into the tubing string 140. The tubing string 140 can include a shut-off seat (not labeled) that is located below the cementing tool 100. The shut-off plug 130 can engage with the shut-off seat and shut off fluid flow past the shut-off plug 130.

With reference to FIG. 3, the methods can also include releasing the port plug 120 from connection with the outer mandrel 102. The port plug 120 can be released by increasing the pressure within the tubing string 140 due to the shut-off plug 130 engaging with the shut-off seat. Because fluid flow is closed at the bottom end of the tubing string 140, any additional pumping of a fluid will cause the pressure in the shut-off portion of the tubing string 140 to increase. When the pressure inside the tubing string 140 reaches the force rating of the frangible device 121 of the port plug 120, the frangible device 121 will break or shear. The shearing of the frangible device 121 allows the pressure inside the tubing string 140 to expel the port plug 120 into the annulus 151. After expulsion, a fluid flow path is created from the inside of the tubing string 140 in direction D1 and through the flow port 103 in direction D3.

As discussed above, the cementing tool 100 can include more than one flow port 103 and port plug 120. Additional flow ports and port plugs can be used for redundancy in the event the frangible device 121 of one of the port plugs 120 does not shear at the predetermined force rating. Moreover, it may be difficult if not impossible to shear the frangible device 121 of every port plug 120 at the same time. If one frangible device 121 shears before the other devices, then the pressure inside the tubing string 140 can inherently decrease due to the newly created fluid flow path through the flow port 103. This decrease in pressure may not be sufficient to shear the remaining, un-sheared frangible devices. Accordingly, the dimensions of the flow port 103 can be designed to assume fluid flow will only occur through one flow port 103.

The methods can include introducing a second cement composition into the annulus 151 via the flow port 103. The second cement composition can be pumped, for example, from the wellhead and into the annulus 151. The second cement composition can have the same or different properties from the first cement composition. The second cement composition can be a tail cement slurry. Additional cement compositions can be introduced after the second cement composition. Any additional cement compositions will also flow through the flow path of the flow port 103.

Figure 4:
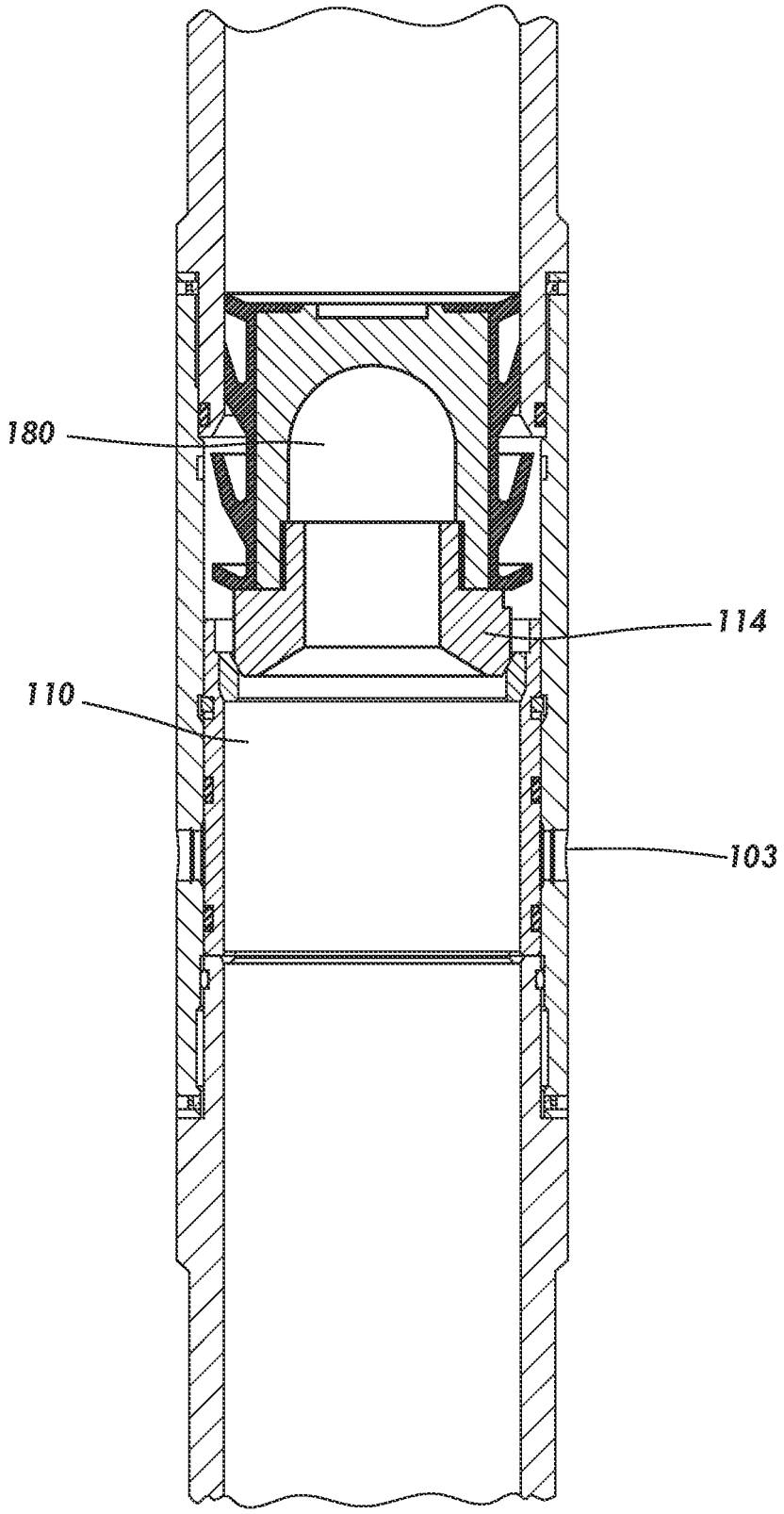
FIG. 4 illustrates the cementing tool in a closed position after all cementing stages have been performed.

At the conclusion of all stages of the cementing operation, it is common to close the tubing string. The methods can include closing the fluid flow path through the flow port 103. Turning to FIG. 4, the closing sleeve 110 can include a seat 114. The flow port 103 can be closed by dropping or pumping a closing plug 180 into the cementing tool 100. The closing plug 180 can engage with the seat 114 and create a seal, thereby blocking fluid flow past the seat 114. Pressure can then be increased within the tubing string 140 above the seat 114. When the pressure in the tubing string 140 reaches or exceeds the force rating of the frangible device 112 of the closing sleeve 110, the frangible device 112 can break or shear. The closing sleeve 110 can then shift to close the flow port 103. Continued downward travel of the closing sleeve 110, which could open the flow port 103, can be prevented by a shoulder or other abutment on the outer mandrel 102 that keeps the flow port 103 closed to fluid communication.

It may be desirable to restore fluid communication through the tubing string 140, for example, after the cement compositions have set in the annulus 151. A drilling or milling device can be used to remove all components, such as the closing plug 180, seat 114, and shut-off plug 130, that prevent fluid flow through the tubing string 140. The seat 114 can have a smaller surface area and can be made with less material compared to traditional seats. This unique advantage can significantly reduce the time required to drill out the components. Additionally, by eliminating the more traditional two-sleeve assembly means that only one plug and one seat have to be drilled out compared to two plugs and two seats, which also reduces the time required to drill out the components.

The components of the cementing tool can be made from a variety of components including, but not limited to, metals, metal alloys, composites, plastics, and rubbers.

An embodiment of the present disclosure is a multi-stage cementing tool for cementing in a wellbore, the cementing tool comprising: a body configured to fit within a tubing string; an outer mandrel located around an outside of at least a portion of the body; a flow port, wherein the flow port is defined by an opening that traverses through a portion of the outer mandrel for fluid communication with an inside of the tubing string and an annulus of the wellbore; a port plug, wherein the port plug is releasably connected to the outer mandrel by a frangible device, and wherein the port plug is located within the flow port when the port plug is releasably connected to the outer mandrel; and a closing sleeve located within the body and positioned above the flow port when the closing sleeve is in a pre-shifted position. Optionally, the tool further comprises wherein the port plug is made from metals, metal alloys, composite materials, dissolvable materials, or hardened plastics. Optionally, the tool further comprises wherein the force rating of the port plug is greater than or equal to the force rating of the tubing string. Optionally, the tool further comprises wherein the flow port comprises a shoulder, wherein a bottom end of the port plug comprises tapered side walls, and wherein the bottom end of the port plug shoulders up against the shoulder of the flow port such that the port plug is prevented from releasing through the flow port and into the inside of the tubing string. Optionally, the tool further comprises wherein the frangible device is selected from a shear pin, a shear screw, a shear ring, a load ring, a lock ring, a rupture disk, a pin, or a lug. Optionally, the tool further comprises wherein the force rating of the frangible device is less than 80% of the force rating of the tubing string. Optionally, the tool further comprises wherein the closing sleeve is held in the pre-shifted position via a frangible device. Optionally, the tool further comprises wherein the port plug comprises one or more sealing elements located around an outer perimeter of the port plug, and wherein the one or more sealing elements restrict or prevent fluid flow between an inner perimeter of the flow port and the outer perimeter of the port plug. Optionally, the tool further comprises wherein the closing sleeve comprises a lock ring, one or more sealing elements, or both a lock ring and one or more sealing elements.

Another embodiment of the present disclosure is a method of performing a multi-stage cementing operation in a wellbore comprising: introducing a tubing string and a cementing tool installed within the tubing string into the wellbore, wherein the cementing tool comprises: a body configured to fit within a tubing string; an outer mandrel located around an outside of at least a portion of the body; a flow port, wherein the flow port is defined by an opening that traverses through a portion of the outer mandrel for fluid communication with an inside of the tubing string and an annulus of the wellbore; a port plug, wherein the port plug is releasably connected to the outer mandrel by a frangible device, and wherein the port plug is located within the flow port when the port plug is releasably connected to the outer mandrel; and a closing sleeve located within the body and positioned above the flow port when the closing sleeve is in a pre-shifted position; introducing a first cement composition into the wellbore through the tubing string; closing a fluid flow path through a bottom end of the tubing string; releasing the port plug from connection with the outer mandrel, wherein releasing the port plug opens the flow port to fluid communication from the inside of the tubing string and the annulus of the wellbore; and introducing a second cement composition into the annulus via the flow port. Optionally, the method further comprises wherein the force rating of the port plug is greater than or equal to the force rating of the tubing string. Optionally, the method further comprises wherein the flow port comprises a shoulder, wherein a bottom end of the port plug comprises tapered side walls, and wherein the bottom end of the port plug shoulders up against the shoulder of the flow port such that the port plug is prevented from releasing through the flow port and into the inside of the tubing string prior to releasing the port plug from connection with the outer mandrel. Optionally, the method further comprises wherein the frangible device is selected from a shear pin, a shear screw, a shear ring, a load ring, a lock ring, a rupture disk, a pin, or a lug. Optionally, the method further comprises wherein the force rating of the frangible device is less than 80% of the force rating of the tubing string. Optionally, the method further comprises wherein closing a fluid flow path through a bottom end of the tubing string comprises flowing a shut-off plug into the tubing string, wherein the shut-off plug engages with a shut-off seat located within the tubing string, and wherein engagement of the shut-off plug with the shut-off seat restricts fluid flow through the bottom end of the tubing string. Optionally, the method further comprises wherein releasing the port plug from connection with the outer mandrel comprises increasing pressure within the tubing string after the fluid flow path through a bottom end of the tubing string is closed. Optionally, the method further comprises wherein the port plug is released via shearing of the frangible device. Optionally, the method further comprises wherein the closing sleeve is held in the pre-shifted position via a frangible device that releasably connects the closing sleeve to the outer mandrel. Optionally, the method further comprises shifting the closing sleeve from the pre-shifted position to a shifted position, wherein the closing sleeve blocks fluid flow through the flow port in the shifted position. Optionally, the method further comprises wherein shifting of the closing sleeve comprises: causing a closing plug to engage with a seat located on an inside of the closing sleeve, wherein engagement of the closing plug with the seat restricts fluid flow past the seat; and increasing pressure within the tubing string above the seat, wherein the increased pressure causes the frangible device to shear.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more cement compositions, flow ports, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A multi-stage cementing tool for cementing in a wellbore, the cementing tool comprising:

a body configured to fit within a tubing string;

an outer mandrel located around an outside of at least a portion of the body;

a flow port, wherein the flow port is defined by an opening that traverses through a portion of the outer mandrel for fluid communication with an inside of the tubing string and an annulus of the wellbore;

a port plug, wherein the port plug is releasably connected to the outer mandrel by a frangible device, and wherein the port plug is located within the flow port when the port plug is releasably connected to the outer mandrel; and only one sleeve, wherein the only one sleeve is a closing sleeve located within the body and positioned above the flow port when the closing sleeve is in a pre-shifted position, and wherein the closing sleeve does not shift to open the flow port.

2. The multi-stage cementing tool according to claim 1, wherein the port plug is made from metals, metal alloys, composite materials, dissolvable materials, or hardened plastics.

3. The multi-stage cementing tool according to claim 1, wherein a force rating of the port plug is greater than or equal to a force rating of the tubing string.

4. The multi-stage cementing tool according to claim 1, wherein the flow port comprises a shoulder, wherein a bottom end of the port plug comprises tapered side walls, and wherein the bottom end of the port plug shoulders up against the shoulder of the flow port such that the port plug is prevented from releasing through the flow port and into the inside of the tubing string.

5. The multi-stage cementing tool according to claim 1, wherein the frangible device is selected from a shear pin, a shear screw, a shear ring, a load ring, a lock ring, a rupture disk, a pin, or a lug.

6. The multi-stage cementing tool according to claim 1, wherein a force rating of the frangible device is less than 80% of a force rating of the tubing string.

7. The multi-stage cementing tool according to claim 1, wherein the closing sleeve is held in the pre-shifted position via a frangible device.

8. The multi-stage cementing tool according to claim 1, wherein the port plug comprises one or more sealing elements located around an outer perimeter of the port plug, and wherein the one or more sealing elements restrict or prevent fluid flow between an inner perimeter of the flow port and the outer perimeter of the port plug.

9. The multi-stage cementing tool according to claim 1, wherein the closing sleeve comprises a lock ring, one or more sealing elements, or both a lock ring and one or more sealing elements.

10. A method of performing a multi-stage cementing operation in a wellbore comprising:

introducing a tubing string and a cementing tool installed within the tubing string into the wellbore, wherein the cementing tool comprises:

a body configured to fit within the tubing string;

an outer mandrel located around an outside of at least a portion of the body;

a flow port, wherein the flow port is defined by an opening that traverses through a portion of the outer mandrel for fluid communication with an inside of the tubing string and an annulus of the wellbore;

a port plug, wherein the port plug is releasably connected to the outer mandrel by a frangible device, and wherein the port plug is located within the flow port when the port plug is releasably connected to the outer mandrel; and only one sleeve, wherein the only one sleeve is a closing sleeve located within the body and positioned above the flow port when the closing sleeve is in a pre-shifted position;

introducing a first cement composition into the wellbore through the tubing string;

closing a fluid flow path through a bottom end of the tubing string;

releasing the port plug from connection with the outer mandrel, wherein releasing the port plug opens the flow port to fluid communication from the inside of the tubing string and the annulus of the wellbore, and wherein the flow port is not opened by shifting of the only one sleeve; and introducing a second cement composition into the annulus via the flow port.

11. The method according to claim 10, wherein a force rating of the port plug is greater than or equal to a force rating of the tubing string.

12. The method according to claim 10, wherein the flow port comprises a shoulder, wherein a bottom end of the port plug comprises tapered side walls, and wherein the bottom end of the port plug shoulders up against the shoulder of the flow port such that the port plug is prevented from releasing through the flow port and into the inside of the tubing string prior to releasing the port plug from connection with the outer mandrel.

13. The method according to claim 10, wherein the frangible device is selected from a shear pin, a shear screw, a shear ring, a load ring, a lock ring, a rupture disk, a pin, or a lug.

14. The method according to claim 10, wherein a force rating of the frangible device is less than 80% of a force rating of the tubing string.

15. The method according to claim 10, wherein closing a fluid flow path through a bottom end of the tubing string comprises flowing a shut-off plug into the tubing string, wherein the shut-off plug engages with a shut-off seat located within the tubing string, and wherein engagement of the shut-off plug with the shut-off seat restricts fluid flow through the bottom end of the tubing string.

16. The method according to claim 10, wherein releasing the port plug from connection with the outer mandrel comprises increasing pressure within the tubing string after the fluid flow path through the bottom end of the tubing string is closed.

17. The method according to claim 16, wherein the port plug is released via shearing of the frangible device.

18. The method according to claim 10, wherein the closing sleeve is held in the pre-shifted position via a second frangible device that releasably connects the closing sleeve to the outer mandrel.

19. The method according to claim 18, further comprising shifting the closing sleeve from the pre-shifted position to a shifted position, wherein the closing sleeve blocks fluid flow through the flow port in the shifted position.

20. The method according to claim 19, wherein shifting of the closing sleeve comprises: causing a closing plug to engage with a seat located on an inside of the closing sleeve, wherein engagement of the closing plug with the seat restricts fluid flow past the seat; and increasing pressure within the tubing string above the seat, wherein the increased pressure causes the second frangible device to shear.

* * * * *